US012490827B2

(12) United States Patent
Coghlan

(10) Patent No.: US 12,490,827 B2
(45) Date of Patent: Dec. 9, 2025

(54) FLAT PACK, CLICK-TOGETHER FURNITURE JOINT SYSTEM

(71) Applicant: HOEK HOME LLC, Brooklyn, NY (US)

(72) Inventor: Conor Coghlan, Brooklyn, NY (US)

(73) Assignee: HOEK HOME, LLC, Brooklyn, NY (US)

( * ) Notice: Subject to any disclaimer, the term of this patent is extended or adjusted under 35 U.S.C. 154(b) by 60 days.

(21) Appl. No.: 18/033,715

(22) PCT Filed: Aug. 12, 2021

(86) PCT No.: PCT/US2021/045737

§ 371 (c)(1),
(2) Date: Apr. 25, 2023

(87) PCT Pub. No.: WO2022/040010

PCT Pub. Date: Feb. 24, 2022

(65) Prior Publication Data

US 2023/0389691 A1 Dec. 7, 2023

Related U.S. Application Data

(60) Provisional application No. 63/067,376, filed on Aug. 19, 2020.

(51) Int. Cl.

| | |
|---|---|
| ***A47B 3/06*** | (2006.01) |
| ***A47B 3/12*** | (2006.01) |
| *A47B 3/00* | (2006.01) |

(52) U.S. Cl.

CPC ..... *A47B 3/06* (2013.01); *A47B 3/12* (2013.01); *A47B 2003/008* (2013.01); *A47B 2200/0085* (2013.01)

(58) Field of Classification Search

CPC ..... A47B 3/06; A47B 3/12; A47B 2003/008; A47B 2200/0085

(Continued)

(56) References Cited

U.S. PATENT DOCUMENTS 1,148,070 A * 7/1915 Billingsley ..... A47B 3/12 108/154
1,954,242 A * 4/1934 Heppenstall ..... A47B 47/042 403/381

(Continued)

OTHER PUBLICATIONS

International Search Report and Written Opinion for PCT/US2021/045737 dated Nov. 29, 2021.

*Primary Examiner* — Daniel J Troy
*Assistant Examiner* — Timothy M Ayres
(74) *Attorney, Agent, or Firm* — CARTER, DELUCA & FARRELL LLP

(57) ABSTRACT

A furniture system includes a tabletop and a leg. The tabletop has a chassis system defining a storage slot and including a leg mount defining a leg slot. The leg is receivable within the storage slot to support the leg within the chassis system in a stored configuration. The leg has head and foot end portions. The head end portion has first and second branches that are receivable within the leg slot. The first branch is separated from the second branch by a pivot channel to enable the first branch to pivot relative to the second branch. The second branch is engageable with a first end portion of the leg slot. The first branch is engageable with a second end portion of the leg slot after the second branch is engaged with the leg slot and after the first branch is pivoted relative to the pivot channel.

18 Claims, 16 Drawing Sheets

(58) Field of Classification Search
USPC ..... 108/153.1
See application file for complete search history.

(56) References Cited

U.S. PATENT DOCUMENTS

| | | | | | |
|---|---|---|---|---|---|
| 2,369,930 | A * | 2/1945 | Wagner, Sr. | A47C 9/04 | 248/188.91 |
| 3,300,245 | A * | 1/1967 | Rumble | A47B 3/12 | 297/440.13 |
| 3,556,451 | A | 1/1971 | Ostlund | | |
| 3,730,109 | A * | 5/1973 | Kreizel | A47B 3/12 | 297/440.22 |
| 5,203,528 | A * | 4/1993 | Oke | A47B 91/06 | D6/709.16 |
| 5,251,955 | A * | 10/1993 | Sarafa | A47C 4/03 | D6/337 |
| 5,644,995 | A * | 7/1997 | Gurwell | A47B 3/12 | 108/188 |
| 9,719,542 | B2 * | 8/2017 | Cappelle | A47B 88/913 | |
| 10,415,612 | B2 | 9/2019 | Davis et al. | | |
| 10,610,010 | B2 * | 4/2020 | Matlin | F16M 11/2014 | |
| 10,842,262 | B2 * | 11/2020 | Zimmerman | A47B 1/04 | |
| 11,154,137 | B2 * | 10/2021 | Davis | A47C 4/021 | |
| 11,350,740 | B2 * | 6/2022 | Leng | A47B 21/02 | |
| 11,638,501 | B2 * | 5/2023 | Ruhman | B26B 29/063 | 269/289 R |
| 2009/0107368 | A1 * | 4/2009 | Austin | A47B 9/18 | 108/147.18 |
| 2011/0012392 | A1 | 1/2011 | Herschler | | |
| 2012/0280550 | A1 | 11/2012 | College | | |

* cited by examiner

FLAT PACK, CLICK-TOGETHER FURNITURE JOINT SYSTEM

CROSS REFERENCE TO RELATED APPLICATIONS

This application claims the benefit of U.S. Provisional Application Ser. No. 63/067,376, filed Aug. 19, 2020, the entire contents of which are incorporated herein by reference.

TECHNICAL FIELD

This disclosure relates to furniture, and more particularly, to flat-pack, click-together furniture.

BACKGROUND

Flat-pack, click-together furniture is often assembled by the end user from flat pieces and is thus easy to store and transport in the un-assembled form. Flat-pack, click-together furniture often suffers from instability, and in some instances is made overly complex or uses more permanent fastening or construction methods to stabilize the furniture. This, however, makes the furniture more cumbersome for the end user and reduces some of the portability and ease of use associated with this type of furniture. Additionally, the use of fasteners, such as screws or nails, to stabilize the furniture often prolongs an amount of time required for assembly and perpetuates the difficulty of such assembly.

SUMMARY

In accordance with an aspect, this disclosure is directed to a flat pack, click-together furniture system that includes a tabletop and a leg. The tabletop has a top side and a bottom side. The bottom side has a chassis system. The chassis system includes a leg mount defining an elongated leg slot. The chassis system further defines a storage slot. The leg is receivable within the storage slot to support the leg within the chassis system in a stored configuration in which the furniture system has a low profile. The leg has a head end portion and a foot end portion. The head end portion has a first branch and a second branch that are receivable within the elongated leg slot. The first branch is separated from the second branch by a pivot channel to enable the first branch to pivot relative to the second branch. The second branch is engageable with a first end portion of the elongated leg slot. The first branch is engageable with a second end portion of the elongated leg slot after the second branch is engaged with the elongated leg slot and after the first branch is pivoted relative to the pivot channel.

In aspects, the first branch may be coupled to the leg by a hinge.

In aspects, the first branch may include a first tab on a first side thereof, and wherein each leg mount may define a first tab recess. The first tab recess may be positioned to receive the first tab when the first branch pivots from a temporary position thereof to a permanent position thereof. The second branch may include a second tab on a first side thereof, and wherein each leg mount may define a second tab recess. The second tab recess may be configured to receive the second tab before the first tab. The second tab may act as a fulcrum about which the respective leg pivots.

In aspects, the plurality of legs may include flexible material. The flexible material may include at least one of HDPE or plywood.

In aspects, each storage slot of the plurality of storage slots includes a locking rib that is receivable between the first and second branches of a respective leg to secure the respective leg within the respective storage slot. Each storage slot may include a protuberance that engages a bottom surface of a respective leg of the plurality of legs to facilitate securement of the respective leg within the respective storage slot.

In aspects, the foot end portion of the leg may be angled relative to the head end portion of the leg.

According to yet another aspect, this disclosure is directed to a flat pack, click-together furniture system. The furniture system includes a tabletop and a leg. The tabletop has a top side and a bottom side. The bottom side has a chassis system. The chassis system includes a leg mount defining an elongated leg slot. The chassis system further defines a storage slot. The leg is receivable within the storage slot to support the leg within the chassis system in a stored configuration in which the furniture system has a low profile. The leg has a head end portion and a foot end portion. The head end portion has a first branch and a second branch that are receivable within the elongated leg slot. The first branch is separated from the second branch by a pivot channel to enable the first branch to pivot relative to the second branch. The second branch is engageable with a first end portion of the elongated leg slot. The first branch is engageable with a second end portion of the elongated leg slot after the second branch is engaged with the elongated leg slot and after the first branch is pivoted relative to the pivot channel.

In aspects, the first branch may include a first tab on a first side thereof, and wherein the leg mount may define a first tab recess. The first tab recess may be positioned to receive the first tab when the first branch pivots from a temporary position thereof to a permanent position thereof.

In aspects, the second branch may include a second tab on a first side thereof, and wherein the leg mount may define a second tab recess. The second tab recess may be configured to receive the second tab before the first tab.

In aspects, the storage slot may include a locking rib that is receivable between the first and second branches of the leg to secure the leg within the storage slot. The storage slot may include a protuberance that engages a bottom surface of the leg to facilitate securement of the leg within the storage slot.

In aspects, the furniture system may further include a shelf assembly that is selectively attachable to the tabletop.

BRIEF DESCRIPTION OF DRAWINGS

The accompanying drawings, which are incorporated in and constitute a part of this specification, illustrate aspects of the disclosure and, together with a general description of the disclosure given above and the detailed description given below, explain the principles of this disclosure, wherein.

DETAILED DESCRIPTION

Figure 1:
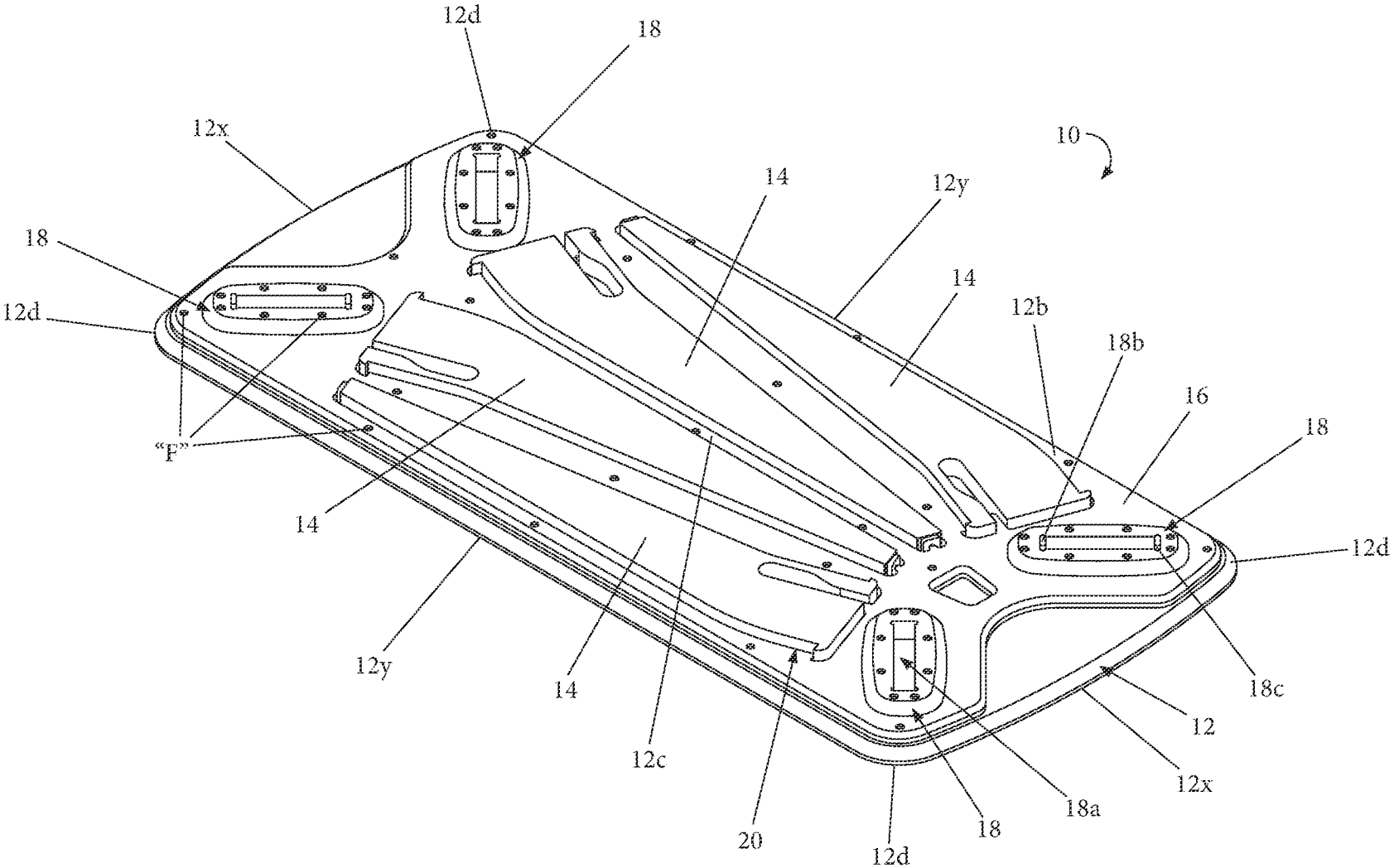
FIG. 1 is a bottom, perspective view of a furniture system in a storage configuration in accordance with the principles of this disclosure.

Aspects of the disclosed systems and methods are described in detail with reference to the drawings, in which like reference numerals designate identical or corresponding elements in each of the several views. In the following description, well-known functions or constructions are not described in detail to avoid obscuring the present disclosure in unnecessary detail.

Furniture systems of this disclosure are flat pack, click-together furniture joint systems.

With reference to FIGS. 1-6D, furniture system 10 includes a tabletop 12 and a plurality of legs 14 that snap-fit to a chassis system 16 of the tabletop 12. Tabletop 12 includes a top side 12*a*, which generally functions as working surface and bottom side 12*b* that secures legs 14 to tabletop 12. Tabletop 12 also includes long sides 12*y* and short sides 12*x*. Chassis system 16 is disposed on bottom side 12*b* of tabletop 12 and can be secured thereto using, for example, fasteners "F," such as nails or screws, although any suitable securement technique may be utilized (e.g., adhesive, welding, etc.). Chassis system 16 includes a plurality of leg mounts 18 disposed at spaced apart locations about a periphery of chassis system 16 (e.g., one adjacent to each of the four corners 12*d* of table top 12). Each leg mount 18 defines an elongated leg slot 18*a* therein. Elongated leg slot 18*a* includes an inner end portion 18*b* and an outer end portion 18*c*. Inner end portion 18*b* is positioned closer to a center 12*c* of tabletop 12 than the respective outer end portion 18*c*, and outer end portion 18*c* is disposed closer to one of the respective corners 12*d* of tabletop 12 than the respective inner end portion 18*a*. Inner end portion 18*b* defines posterior tab recess 18*d* therein, and outer end portion 18*c* defines an anterior tab recess 18*e* therein. Leg mounts 18 are configured to secure legs 14 to chassis system 16 to maintain furniture system 10 in an assembled configuration where furniture system 10 has an expansive profile.

Chassis system 16 of furniture system 10 further defines a plurality of storage slots 20 for storing the plurality of legs 14 within chassis system 16 to maintain furniture system 10 in a stored configuration where furniture system 10 has a low profile. Each storage slot 20 is shaped to conform to one of the legs 14. Storage slots 20 include a head end portion 20*a* and a foot end portion 20*b*. Head end portion 20*a* includes an anterior tab cutout 20*c* on a first side of head end portion 20*a* and a posterior tab cutout 20*d* on a second side of head end portion 20*a*. Head end portion 20*a* further includes a locking rib 20*e* that is disposed between anterior and posterior tab cutouts 20*c*, 20*d*. Locking rib 20*e* extends from a first end 20*f* of storage slot 20 toward a second end 20*g* of storage slot 20. A protuberance 20*h* extends from second end 20*g* of storage slot 20 on foot end portion 20*b* toward first end 20*f* of storage slot 20.

Legs 14 of furniture system 10 are selectively detachable from the leg mounts 18 of chassis system 16 and are configured to be stored within storage slots 20 for reducing a profile of the system in a flat pack form for easier storage. Each leg 14 includes a head end 14*a* and a foot end 14*b* that is angled relative to head end 14*a* to enable leg 14 to provide increased support to tabletop 12. Although shown to be at an angle "A" of about 10 to 20 degrees relative to a line orthogonal to a floor, angle "A" may have any suitable angle between 0 and 90 degrees relative to the line orthogonal to the floor.

Figures 4A, 4B, 4C, 4D:
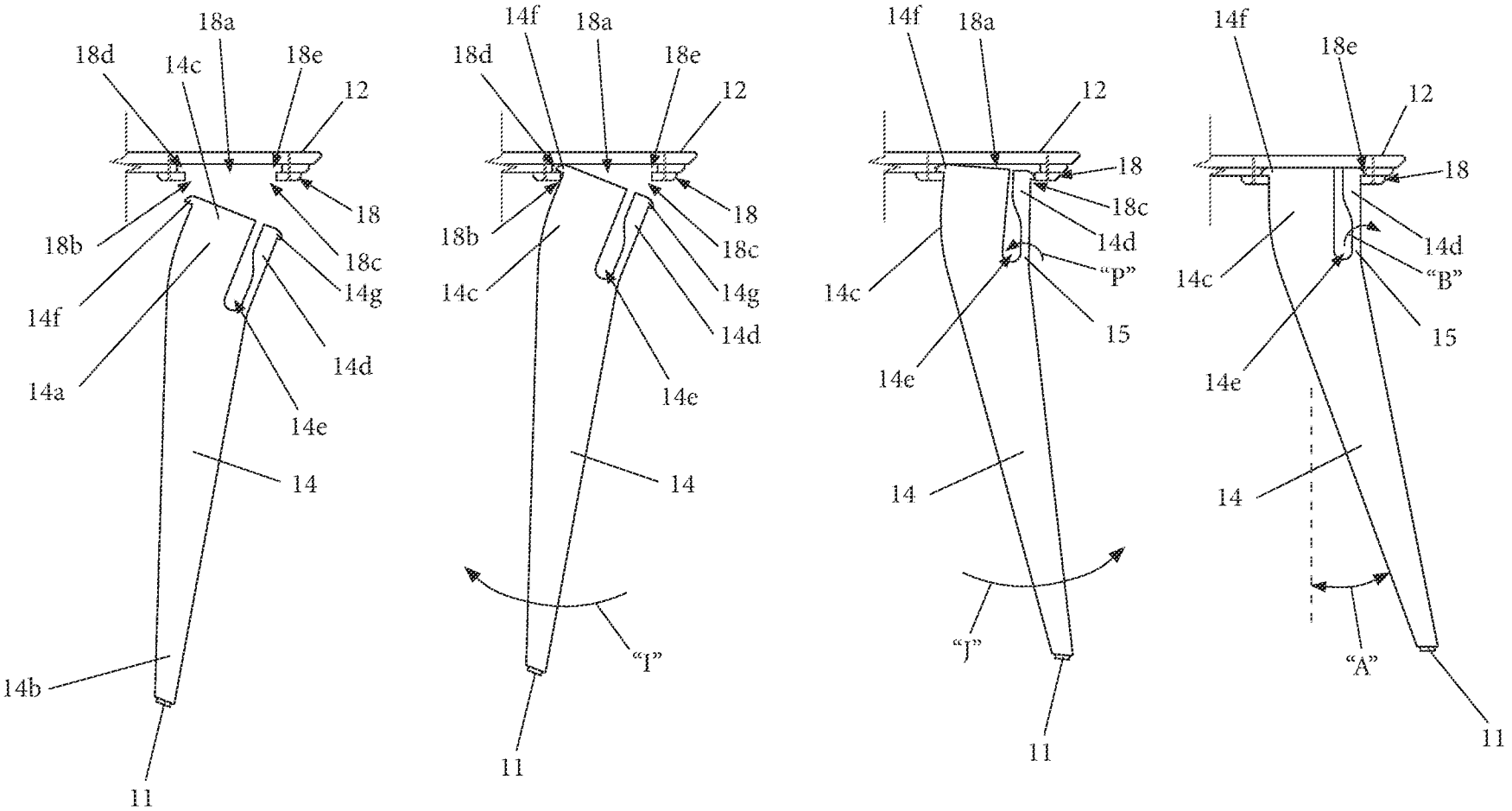
FIGS. 4A-4D are progressive views illustrating a leg of the furniture system of FIGS. 1-3 being secured to a leg mount of a tabletop of the furniture system of FIGS. 1-3 to dispose the furniture system in the assembled configuration.

Head end 14*a* of leg 14 includes a posterior branch 14*c* and an anterior branch 14*d* that are separated by a pivot channel 14*e* that enables anterior branch 14*d* to pivot from a permanent position thereof (see FIG. 4A) to a temporary position thereof (see FIG. 4C). In particular, anterior branch 14*d* is coupled to leg 20 via a hinge 15 and is configured to pivot about hinge 15 into pivot channel 14*e* of leg 14 toward posterior branch 14*c*, as indicated by arrow "P," when an actuation force is applied to anterior branch 14*d*. Such actuation force may be applied, for example, when a user squeezes head end 14*a* and/or depresses anterior branch 14*d* toward posterior branch 14*c*. When the actuation force is removed, anterior branch 14*d* is configured to pivot back toward an initial position thereof (e.g., biased or urged toward its initial position), and away from posterior branch 14*c*, as indicated by arrow "B" (see FIG. 4D). At least portions of the legs 14 are made from a flexible material, such as HDPE or plywood. Posterior branch 14*c* includes a posterior tab 14*f* that is receivable within posterior tab recess 18*d* of leg mount 18 to secure posterior branch 14*c* to inner end portion 18*b* of leg mount 18. Foot end 14*b* may be pivoted in a posterior direction about posterior tab 14*f*, as indicated by arrow "I," to facilitate insertion of posterior tab 14*f* into posterior tab recess 18*d*. Anterior branch 14*d* includes an anterior tab 14*g* that is receivable within anterior tab recess 18*e* of leg mount 18 to secure anterior branch 14*d* to outer end portion 18*c* of leg mount 18 when anterior branch 14*d* pivots back to the initial position thereof In particular, with posterior tab 14*f* received within posterior tab recess 18*d*, foot end 14*b* can be pivoted in an anterior direction (opposite the posterior direction), as indicated by arrow "J", whereby posterior tab 14*f* acts as a fulcrum to pivot anterior branch 14*d* upwardly into elongated leg slot

18*a*. Then, with posterior branch 14*c* and anterior branch 14*d* disposed within elongated leg slot 18*a* of leg mount 18, the applied actuation force can be removed so that anterior tab 14*g* pivots about hinge 15, as indicated by arrow "B," and into anterior tab recess 18*e* of leg mount 18 for locking leg 14 to leg mount 18.

Figure 2:
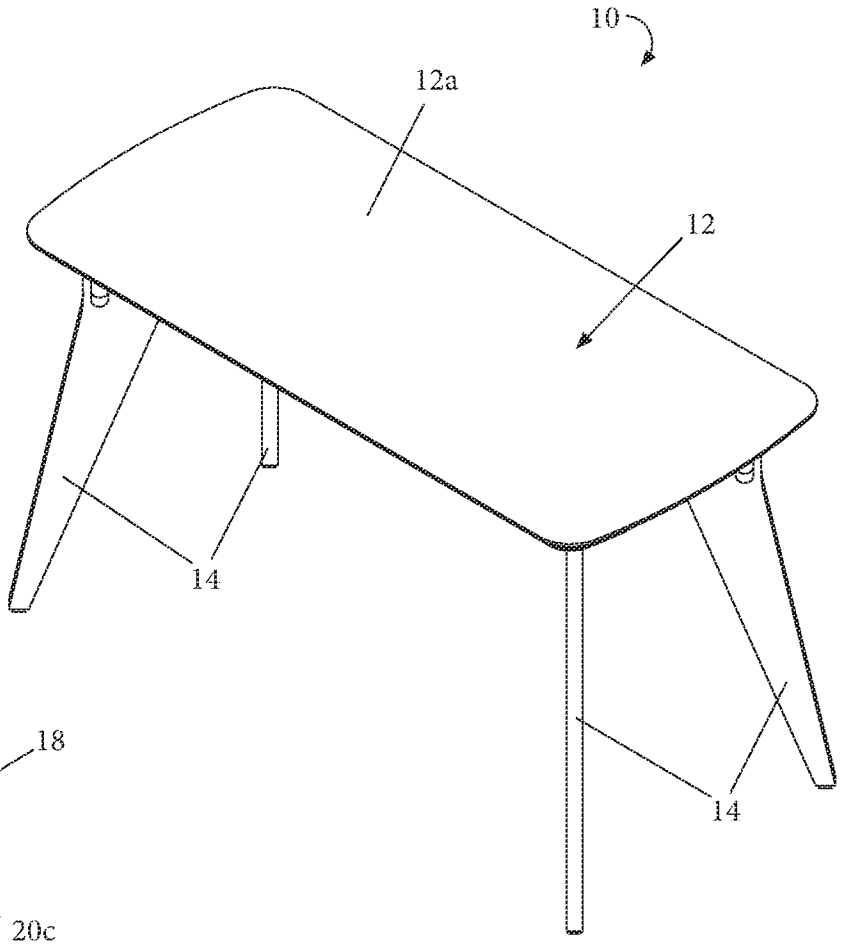
FIG. 2 is a top, perspective view of the furniture system of FIG. 1 in an assembled configuration in accordance with the principles of this disclosure.
Figure 3:
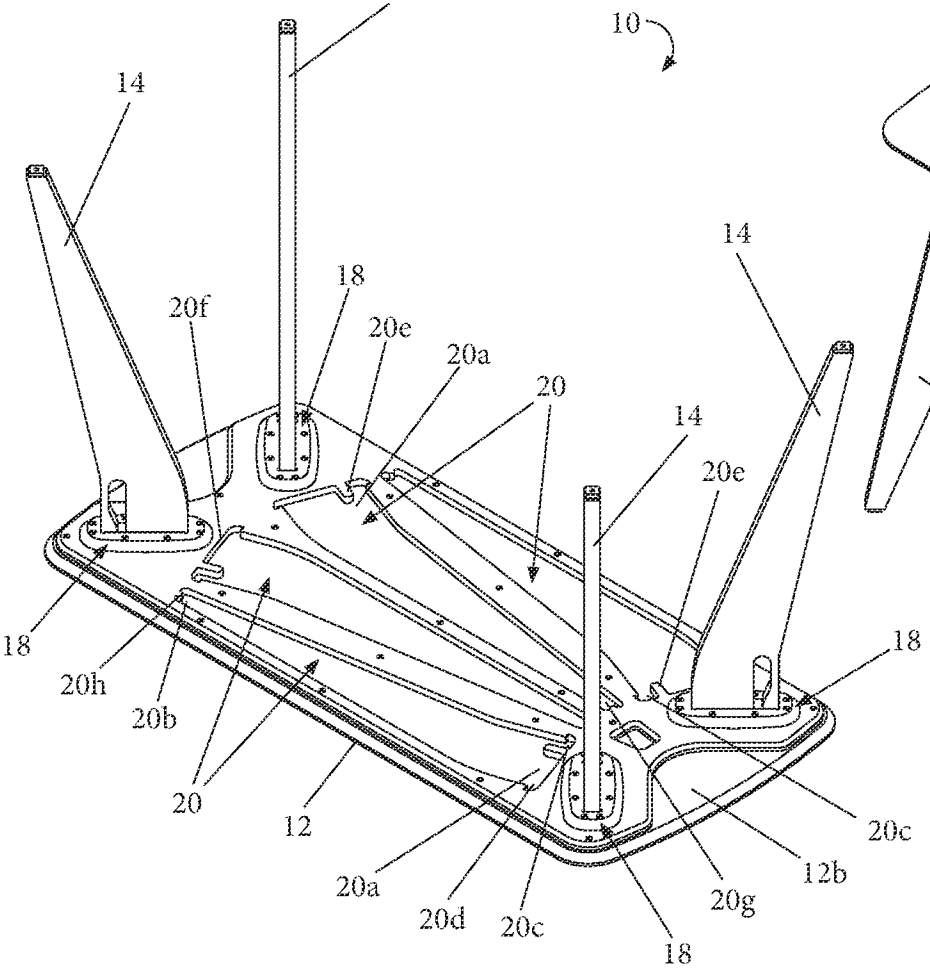
FIG. 3 is a bottom, perspective view of FIG. 2.

Each leg 14 is secured to a respective one of the leg mounts 18 until all four legs 14 are secured to tabletop 12 so that legs 14 can support tabletop 12 off the floor/ground in an assembled configuration (FIG. 2). Each leg 14 can include shoe 11 on a bottom surface of foot end 14*b* to protect the bottom surface of leg 14 and/or a surface of the floor upon which the furniture system 10 is placed.

When the furniture system 10 needs to be moved and/or stored away, each of the legs 14 can be removed by reapplying actuation force to each of the anterior branches 14*d* and pivoting the legs 14 out of the respective leg mounts 18 to separate the legs 14 from tabletop 12.

As best seen in FIGS. 5A-6D, to dispose furniture system 10 in a storage configuration, each leg 14 can be inserted into a respective one of storage slots 20. To help facilitate securement of legs 14 to storage slots 20 of tabletop 12, anterior branch 14*d* of leg 14 defines a rib channel 14*y* in a posterior surface thereof, and posterior branch 14*c* of leg 14 defines a rib channel 14*x* in an anterior surface thereof that is disposed in registration with rib channel 14*y* of anterior branch 14*d*. Rib channels 14*y*, 14*x* are disposed in communication with pivot channel 14*e* and positioned to align with locking rib 20*e* of storage channel 20.

Figure 5B:
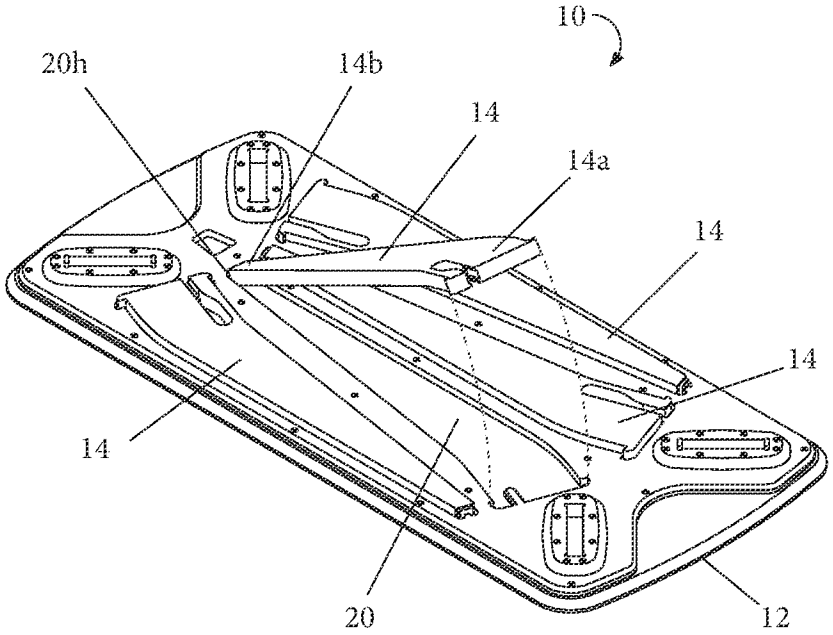
FIGS. 5A-5F are progressive views illustrating a leg of the furniture system of FIGS. 1-3 being secured to a storage slot of the tabletop of the furniture system of FIGS. 1-3 to dispose the furniture system in the storage configuration.
Figure 5A:
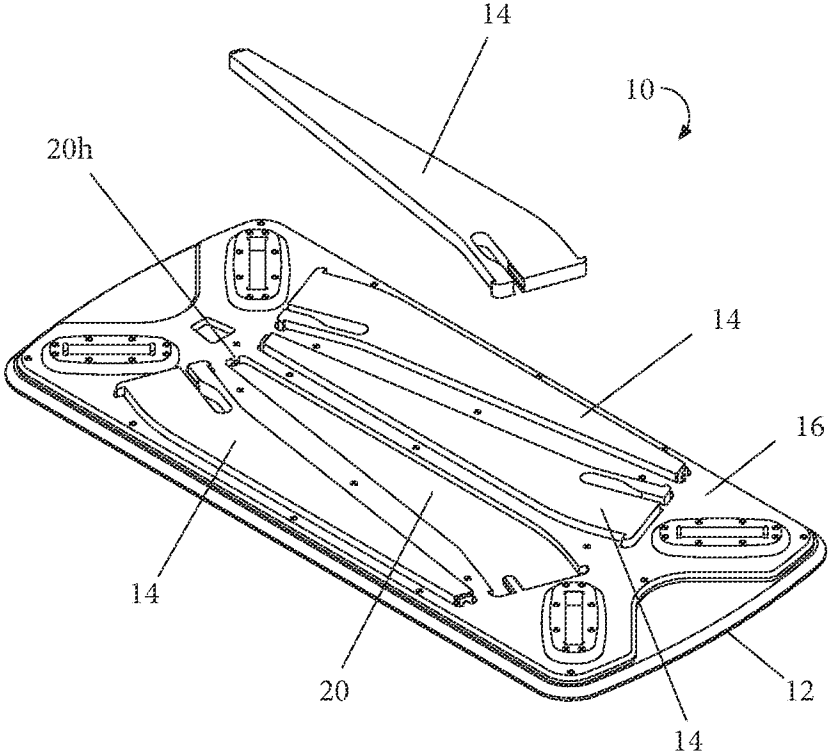
Figure 5C:
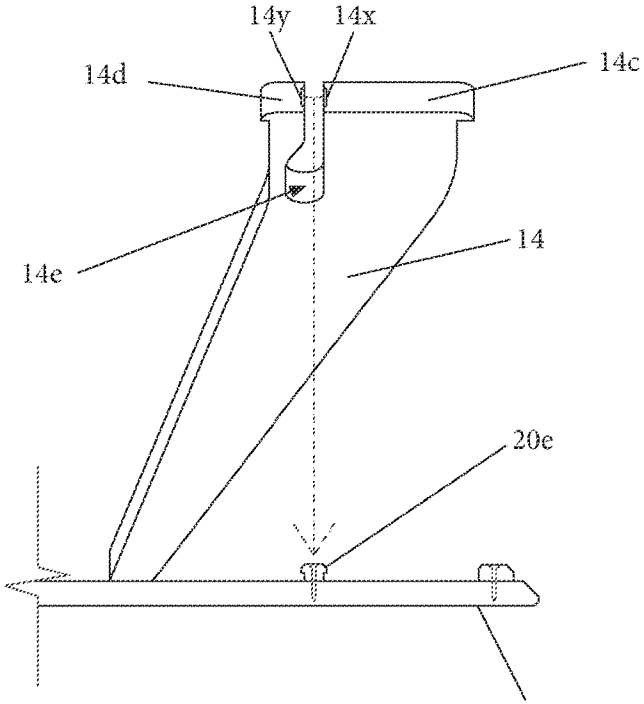
Figure 5D:
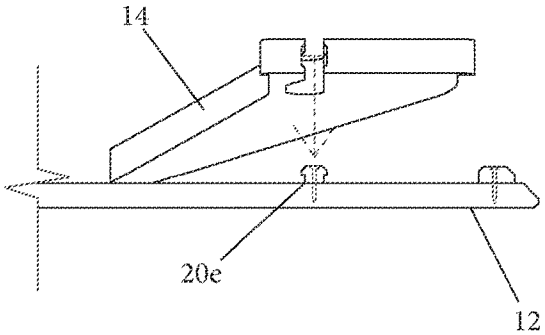
Figure 5E:
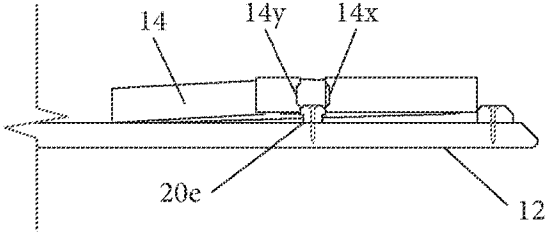
Figure 5F:
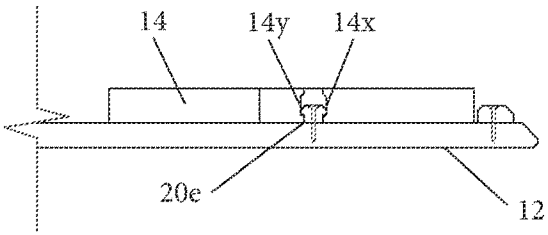
Figure 6B:
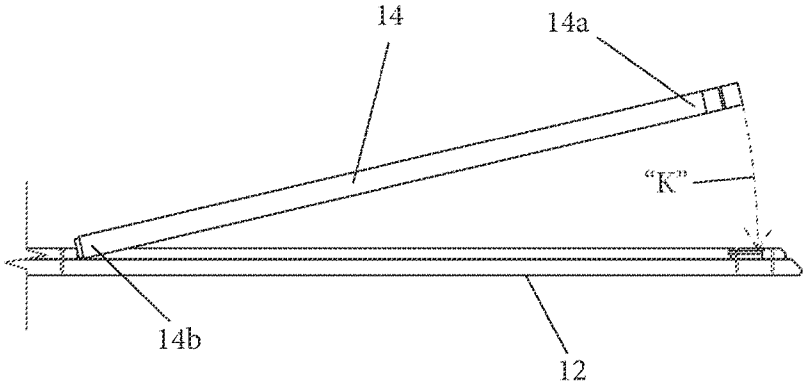
FIGS. 6A-6D are progressive views of illustrating the leg of FIGS. 5A-5F being secured to the storage chassis.
Figure 6D:
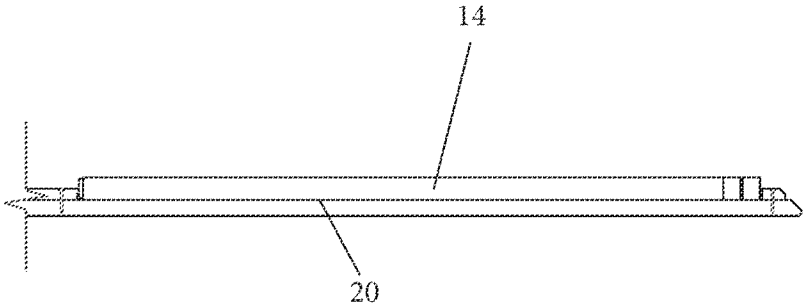
Figure 6A:
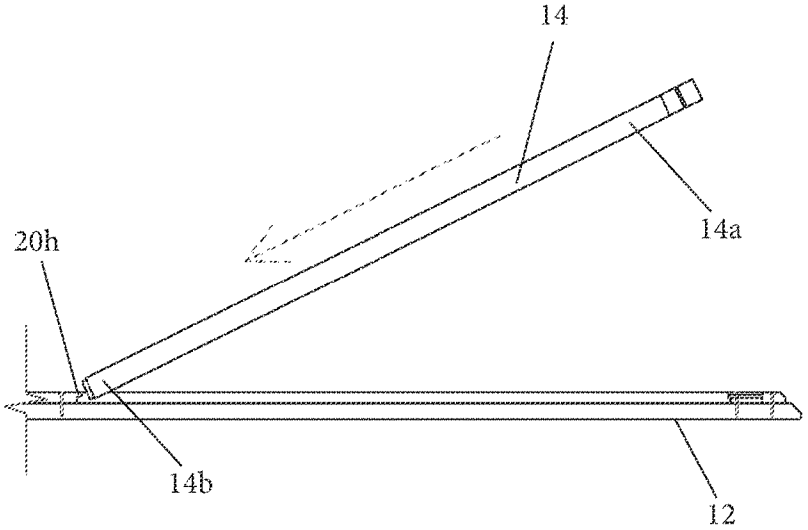
Figure 6C:
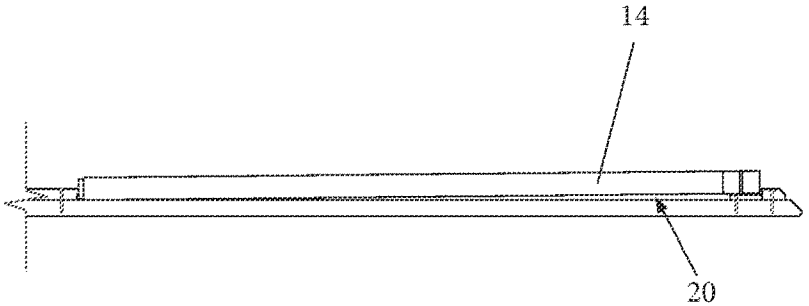
Figure 7B:
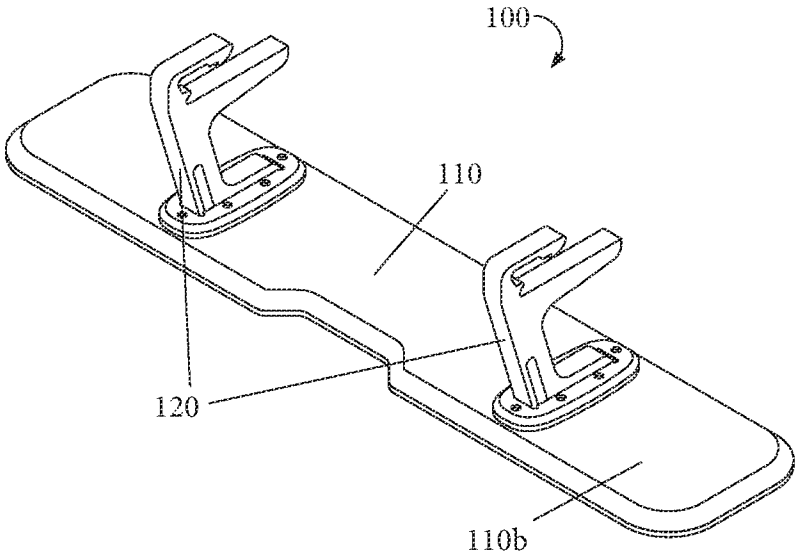
FIG. 7B is a perspective view of the tabletop shelf assembly of FIG. 7A shown in an assembled configuration.
Figure 7A:
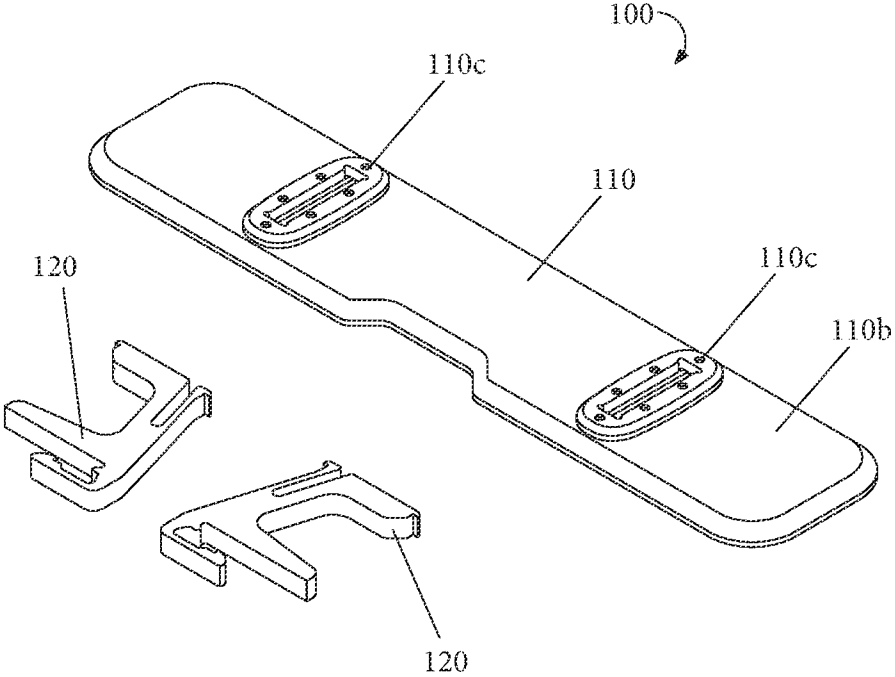
FIG. 7A is a perspective view of a tabletop shelf assembly in accordance with the principles of this disclosure, the tabletop shelf assembly shown in an unassembled configuration.
Figure 8B:
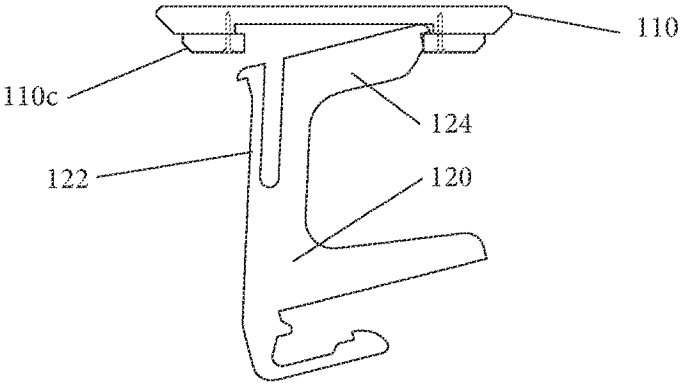
FIGS. 8A-8D are progressive views illustrating a shelf leg of the tabletop shelf assembly being secured to a shelf chassis of a tabletop shelf.
Figure 8D:
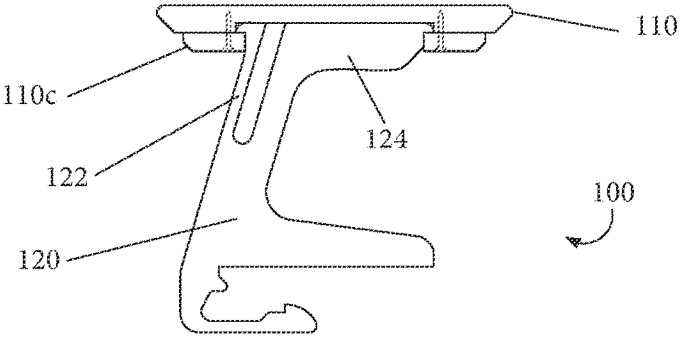
Figure 8A:
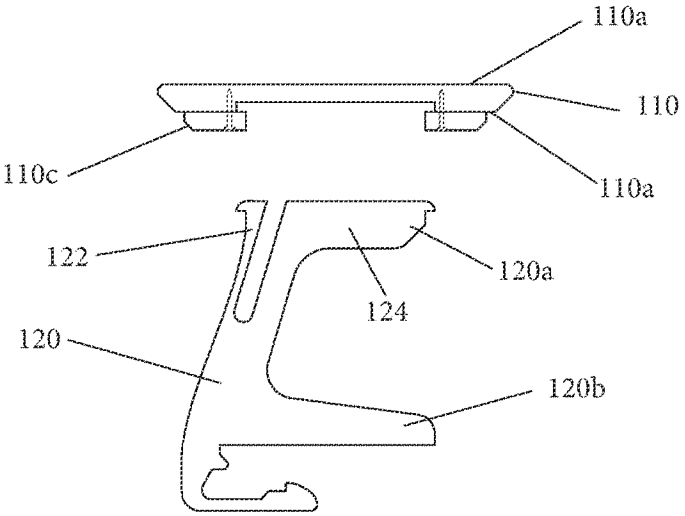
Figure 8C:
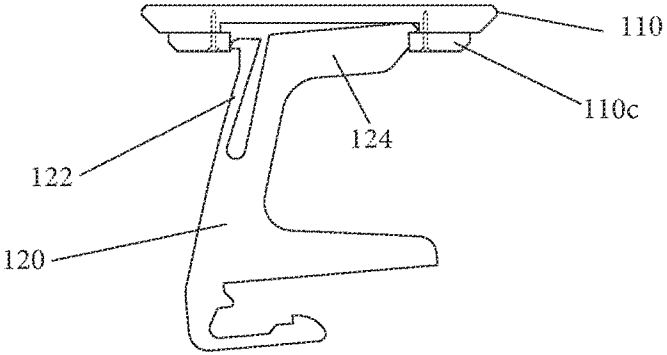
Figure 9:
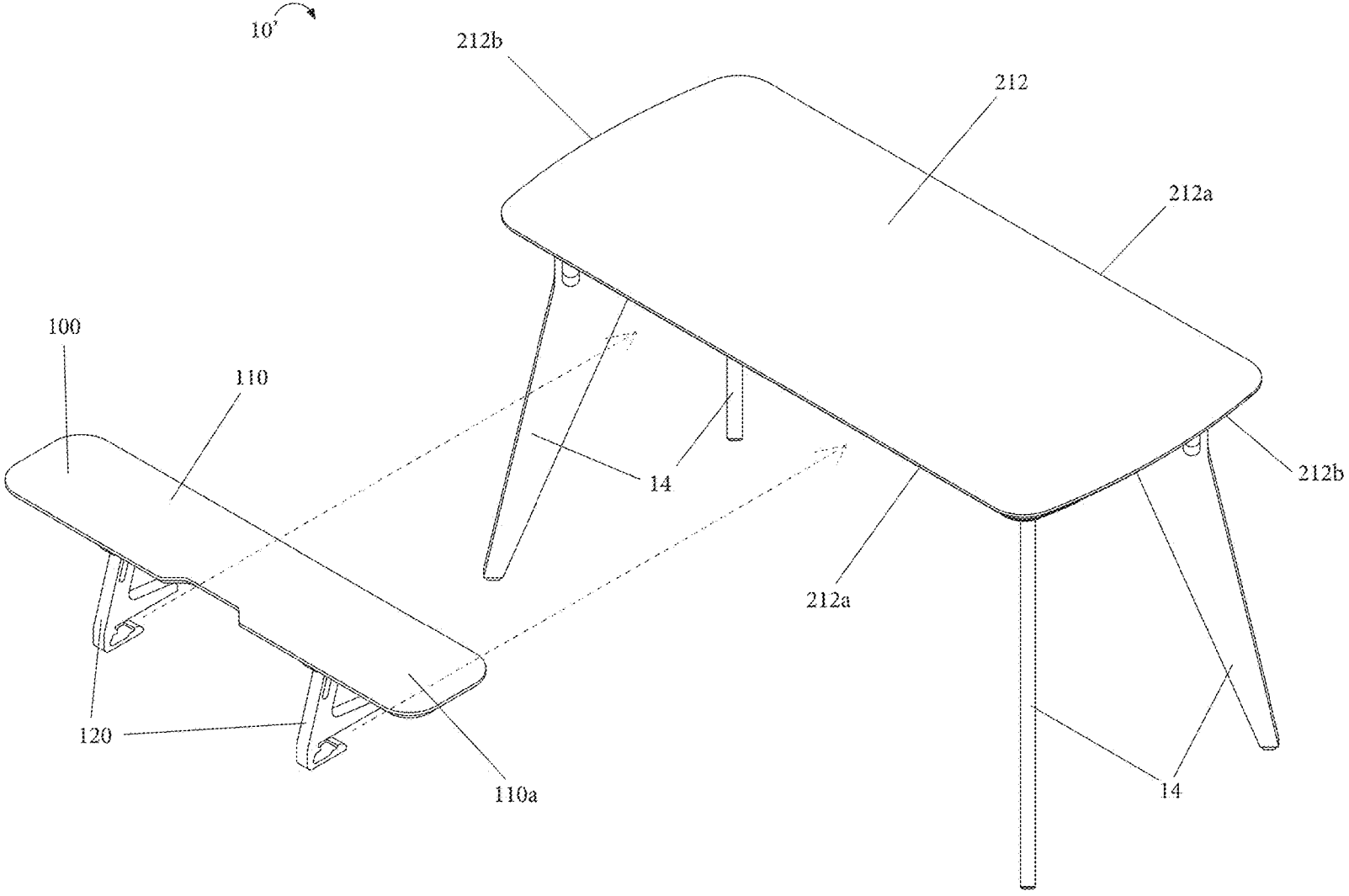
FIGS. 9 and 10 are progressive views illustrating the tabletop shelf assembly of FIG. 7B being secured to another furniture system.
Figure 10:
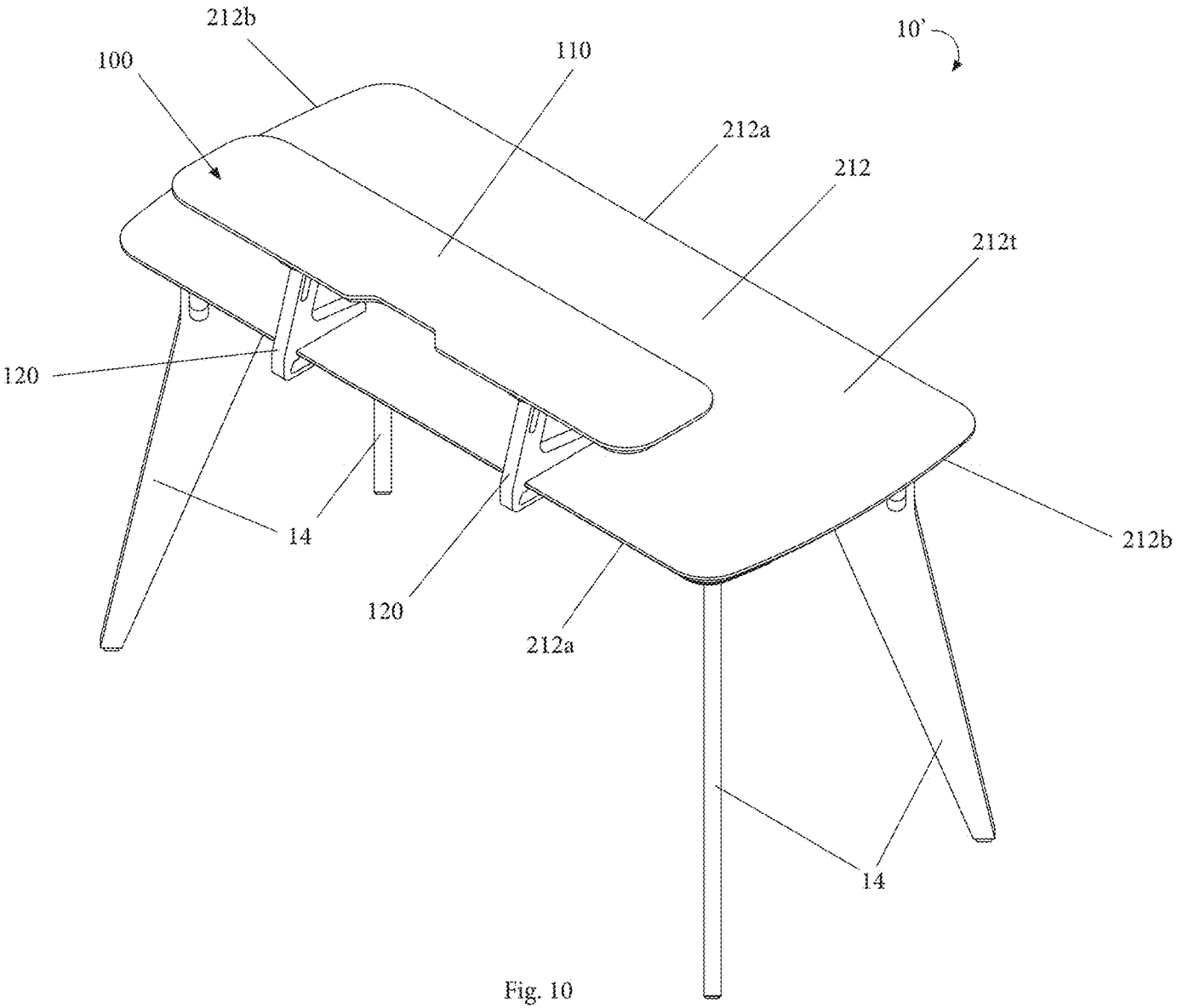

To effectuate insertion of a leg 14 into a storage slot 20, the respective leg 14 is angled relative to the respective storage slot 20 such that foot end 14*b* of the respective leg 14 can be positioned against protuberance 20*h* of the respective storage slot 20 (see FIGS. 5B and 6A). Leg 14 is then pivoted downwards into storage slot 20 about protuberance 20*h*, as indicated by arrow "K" until rib channels 14*y*, 14*x* receive locking rib 20*e* of storage channel 20 (e.g., friction-fit). Locking rib 20*e* and protuberance 20*h* of storage slot 20 secures leg 14 within storage slot 14 so that furniture system 10 can be easily stored. To remove leg 14, anterior and posterior branches 14*d*, 14*c* can be separated away from locking rib 20*e* so that leg 14 can be pivoted out of storage slot 20 as desired to re-assemble furniture system 10.

As can be appreciated, in aspects, the relative positions of the posterior and anterior branches 14*d*, 14*c* (and all the corresponding structure of furniture system 10) can be reversed.

Turning now to FIGS. 7A-11D, one furniture system 10' can include a tabletop shelf assembly 100 that is selectively attachable to a tabletop 212 of furniture system 10'. Tabletop 212 of furniture system 10' is substantially similar to tabletop 12 but includes a shelf rib 214 extending along a long side 212*a* of a bottom surface of tabletop 212. In some aspects, shelf rib 212*a* can extend along a short side 212*b* of the bottom surface of tabletop 212 Tabletop shelf assembly 100 includes a shelf assembly 110 and arm members 120 that couple shelf assembly 110 to tabletop 12. Shelf assembly 110 includes a top surface 110*a* and a bottom surface 110*b* that supports arm mounts 110*c*. Arm mounts 110*c* are substantially similar in structure and operation to leg mounts 18 of tabletop 12 and therefore are not described in further detail in the interest of brevity. Arm member 120 includes a head end portion 120*a* and a foot end portion 120*b*. Head end portion 120*a* includes a first branch 122 that is substantially similar to anterior branch 14*d* of head end portion 14*a* of leg 14, and a second branch 124 that is substantially similar to posterior branch 14*c* of head end portion 14*a* of leg 14. As seen in FIGS. 8A-8D, first and second branch 122, 124 of head end portion 120*a* couple to arm mount 110*c* in substantially the same manner as anterior and posterior branches 14*d*, 14*c* of leg 14 to leg mount 18. Thus, since head end portion 120*a* of arm member 120 is substantially similar in structure and operation as head end portion 14*a* of leg 14, head end portion 120*a* of arm member 120 will not be described in further detail in the interest of brevity.

Figure 11B:
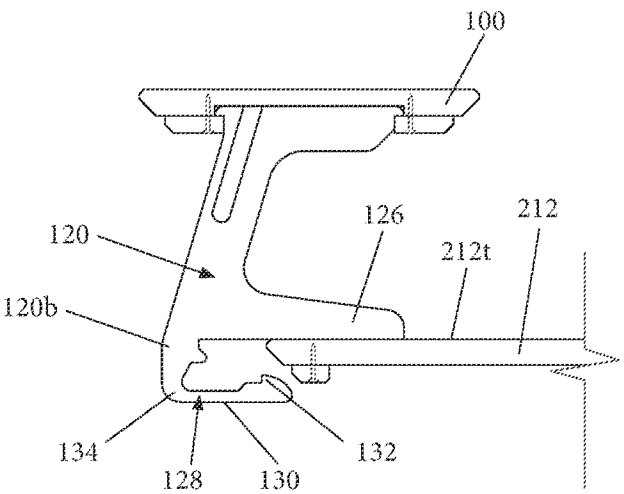
FIGS. 11A-11D are progressive views illustrating the shelf leg of the tabletop shelf assembly of FIG. 7B being coupled to a mounting rib of the furniture system of FIGS. 9A and 9B.
Figure 11A:
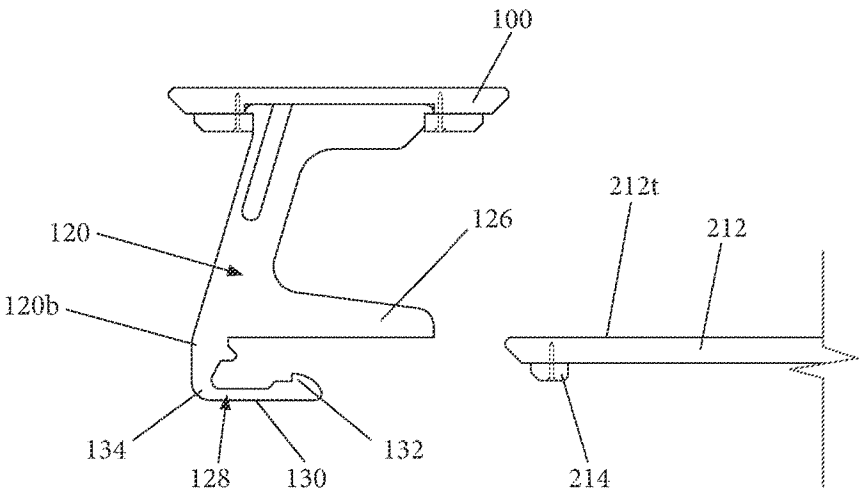
Figure 11D:
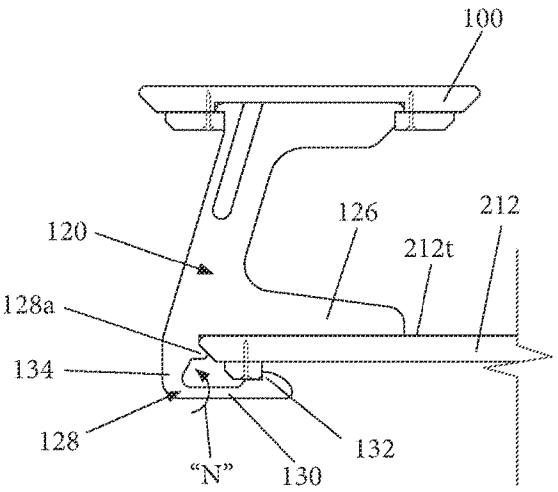
Figure 11C:
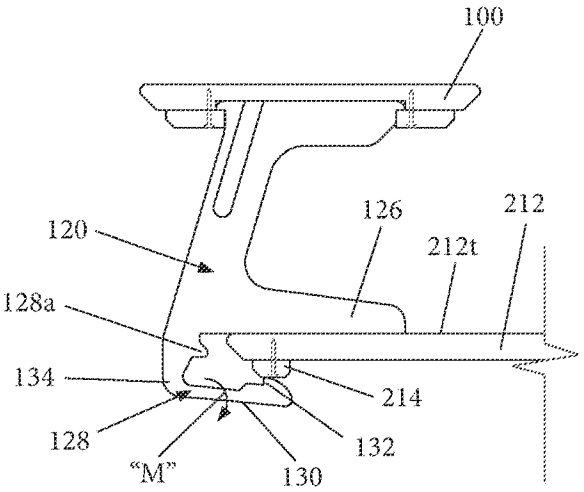
Figure 12A:
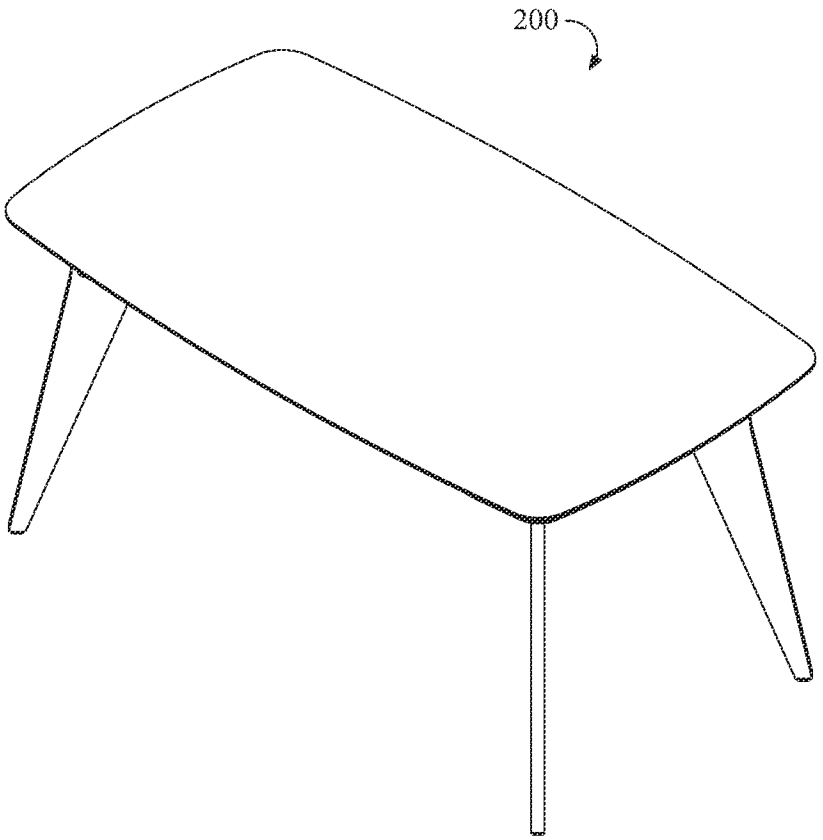
FIGS. 12A and 12B are top and bottom perspective views of another furniture system in assembled configurations in accordance with the principles of this disclosure.
Figure 12B:
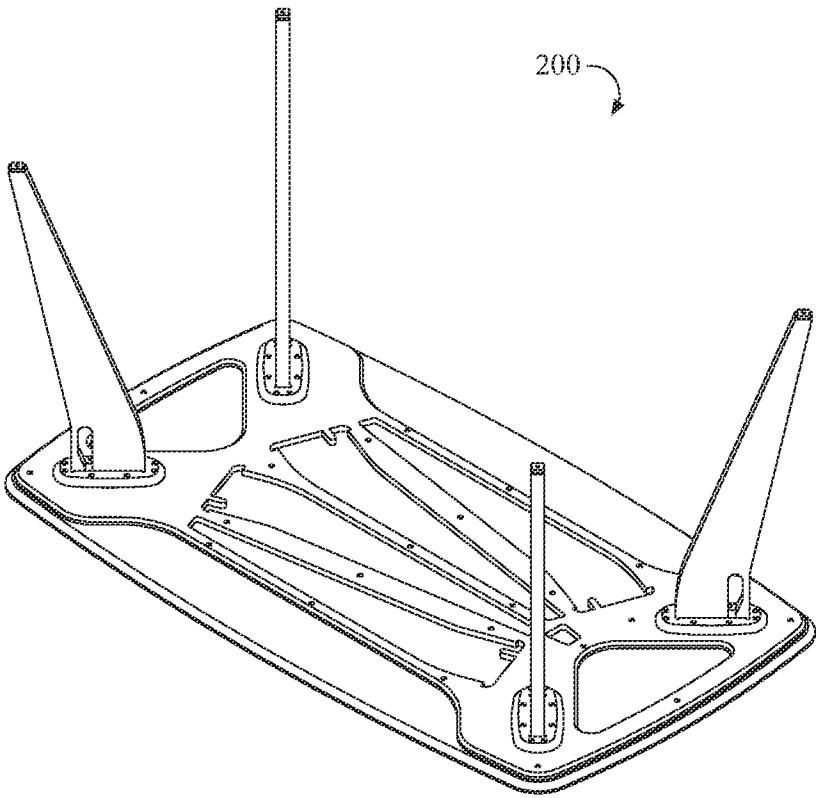
Figure 13A:
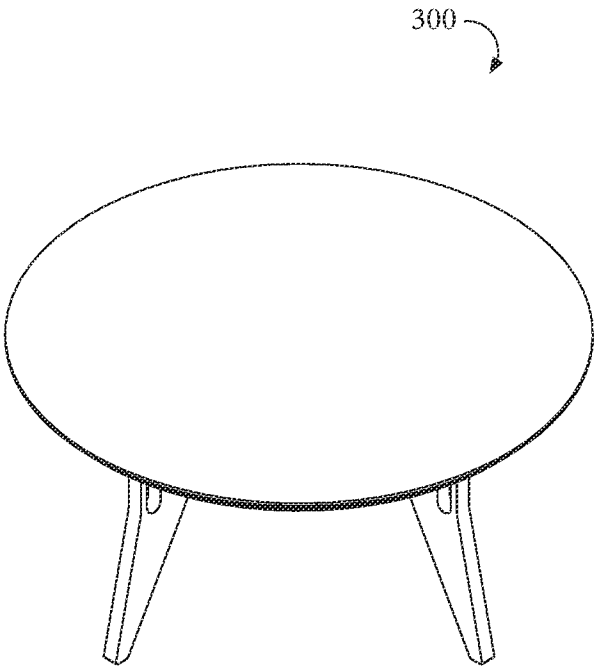
FIGS. 13A and 13B are top and bottom perspective views of still another furniture system in assembled configurations in accordance with the principles of this disclosure.
Figure 13B:
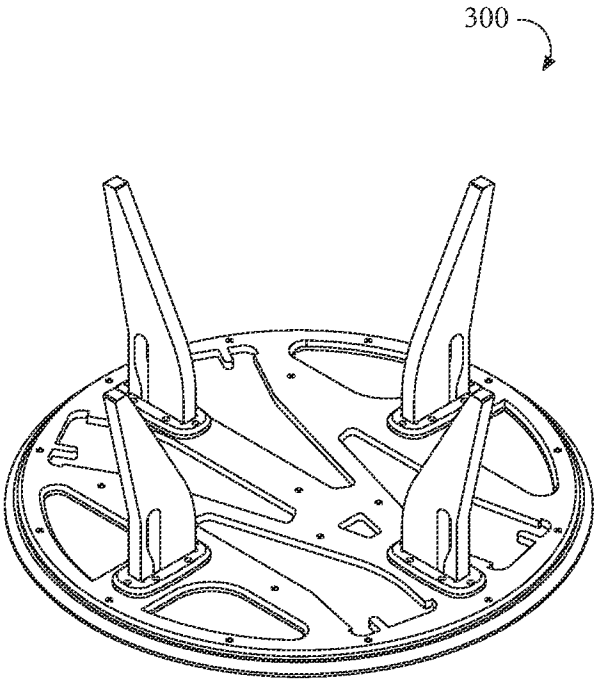
Figure 14A:
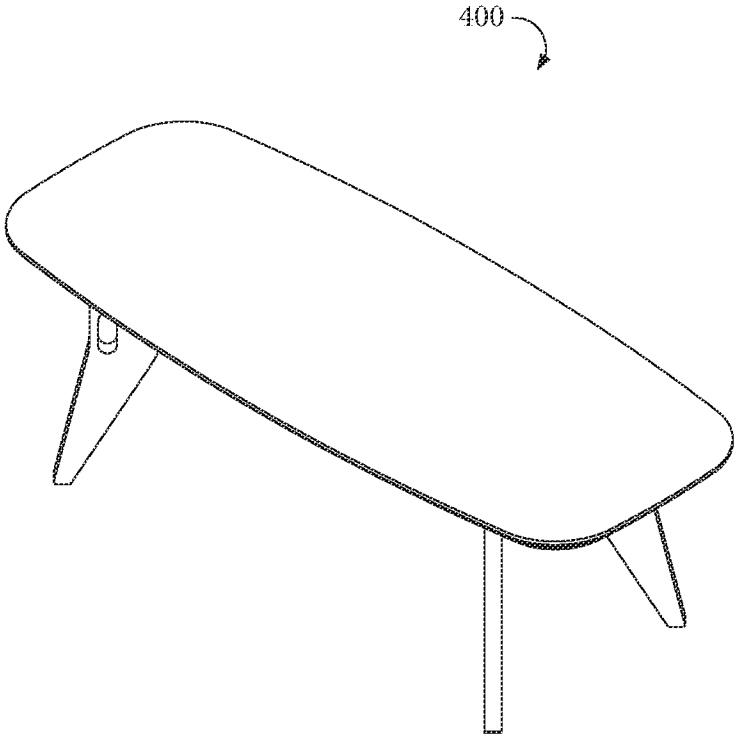
FIGS. 14A and 14B are top and bottom perspective views of yet another furniture system in assembled configurations in accordance with the principles of this disclosure.
Figure 14B:
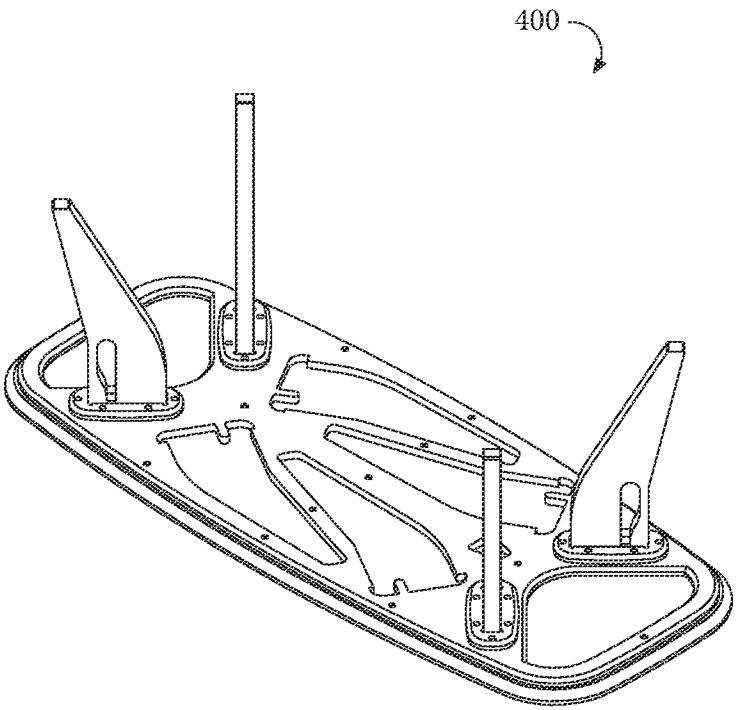
Figure 15A:
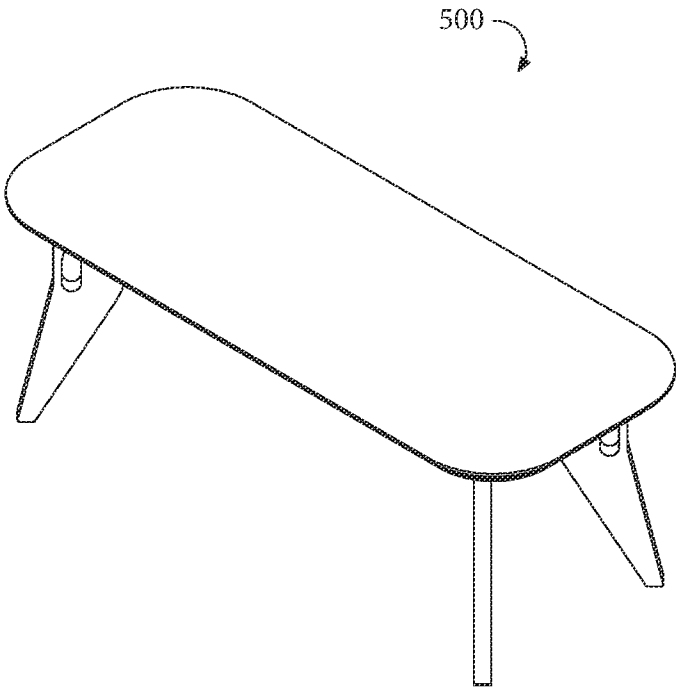
FIGS. 15A and 15B are top and bottom perspective views of another furniture system in assembled configurations in accordance with the principles of this disclosure.
Figure 15B:
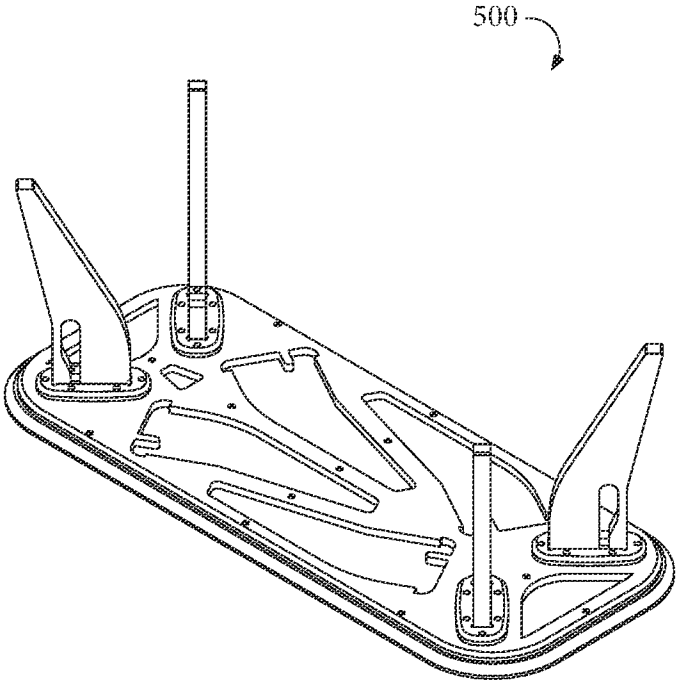
Figure 16A:
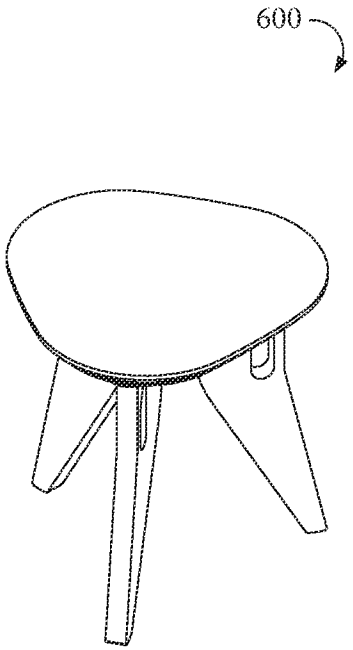
FIGS. 16A and 16B are top and bottom perspective views of yet another furniture system in assembled configurations in accordance with the principles of this disclosure.
Figure 16B:
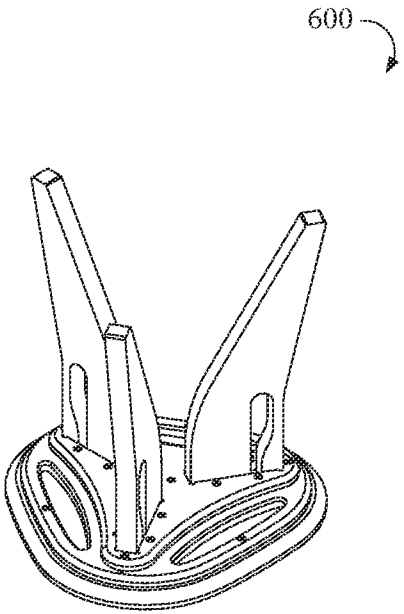

With reference to FIG. 11A, foot end portion 120*b* of arm 120 includes a balance bar 126 that extends distally from arm member 120 and that is configured to slidably mount onto a top surface 212*t* of tabletop 212. Foot end portion 120*b* further includes a flexible hook 128 that depends from a proximal end portion of balance bar 128. Flexible hook 128 includes a table abutment 128*a* configured to engage a side surface of tabletop 212 and a flexible finger 130 having a distal tooth 132. Flexible finger 130 is pivotable about a proximal hinge 134, as indicated by arrows "M" and "N," between an unflexed position (see FIG. 11B) and a flexed position (FIG. 11C) as flexible finger 130 cams along shelf rib 214 of tabletop 212 as tabletop shelf assembly 100 is moved distally into approximation with tabletop 212 to secure tabletop shelf assembly 100 to tabletop 212. To remove tabletop shelf assembly 100 flexible finger 130 is flexed downwardly, as indicated by arrows "M," so that flexible hook 128 can cam proximally along shelf rib 214 as tabletop shelf assembly 100 is slid proximally away from tabletop 212 to separate tabletop shelf assembly 100 from tabletop 212.

Turning now to FIGS. 12A-16B, furniture systems of this disclosure can have any variety of shapes and configurations as illustrated by furniture systems 200, 300, 400, 500, and 600. For instance, the furniture systems of this disclosure may be in the form of a table (e.g., dining, coffee, side, or end table), bench, stool, or other suitable furniture.

Persons skilled in the art will understand that the structures and methods specifically described herein and illustrated in the accompanying figures are non-limiting exemplary aspects, and that the description, disclosure, and figures should be construed merely as exemplary of particular aspects. It is to be understood, therefore, that this disclosure is not limited to the precise aspects described, and that various other changes and modifications may be effectuated by one skilled in the art without departing from the scope or spirit of the disclosure. Additionally, it is envisioned that the elements and features illustrated or described in connection with one exemplary aspect may be combined with the elements and features of another without departing from the scope of this disclosure, and that such modifications and variations are also intended to be included within the scope of this disclosure. Indeed, any combination of any of the disclosed elements and features is within the scope of this disclosure. Accordingly, the subject matter of this disclosure is not to be limited by what has been particularly shown and described.

What is claimed:

1. A flat pack, click-together furniture system, comprising:

a tabletop having a top side and a bottom side, the bottom side having a chassis system, the chassis system including a plurality of leg mounts, each leg mount defining an elongated leg slot; and a plurality of legs, each leg having a head end portion and a foot end portion, the head end portion having a first branch and a second branch that are receivable within the elongated leg slot of a respective one of the plurality of leg mounts, the first branch being separated from the second branch by a pivot channel to enable the first branch to pivot relative to the second branch and the foot end portion, the second branch being fixed relative to the foot end portion and the pivot channel, the second branch engageable with a first end portion of the elongated leg slot, the first branch engageable with a second end portion of the elongated leg slot after the second branch is engaged with the elongated leg slot and after the first branch is pivoted relative to the pivot channel, wherein the chassis system further defines a plurality of storage slots, each leg of the plurality of legs being receivable within a respective one of the plurality of storage slots to support the plurality of legs within the chassis system in a stored configuration in which the furniture system has a low profile, wherein each storage slot of the plurality of storage slots includes a locking rib that is receivable between the first and second branches of a respective leg to secure the respective leg within the respective storage slot.

2. The furniture system of claim 1, wherein the first branch is coupled to the leg by a hinge.

3. The furniture system of claim 1, wherein the first branch includes a first tab on a first side thereof, and wherein each leg mount defines a first tab recess, the first tab recess is positioned to receive the first tab when the first branch pivots from a temporary position thereof to a permanent position thereof.

4. The furniture system of claim 1, wherein the plurality of legs includes flexible material.

5. The furniture system of claim 4, wherein the flexible material includes at least one of HDPE or plywood.

6. The furniture system of claim 3, wherein the second branch includes a second tab on a first side thereof, and wherein each leg mount defines a second tab recess, the second tab recess configured to receive the second tab before the first tab.

7. The furniture system of claim 6, wherein the second tab acts a fulcrum about which the respective leg pivots.

8. The furniture system of claim 1, wherein each storage slot includes a protuberance that engages a bottom surface of a respective leg of the plurality of legs to facilitate securement of the respective leg within the respective storage slot.

9. The furniture system of claim 1, wherein the foot end portion of the leg is angled relative to the head end portion of the leg.

10. A flat pack, click-together furniture system, comprising:

a tabletop having a top side and a bottom side, the bottom side having a chassis system, the chassis system including a leg mount defining an elongated leg slot; and a leg having a head end portion and a foot end portion, the head end portion having a first branch and a second branch that are receivable within the elongated leg slot, the first branch being separated from the second branch by a pivot channel to enable the first branch to pivot relative to the second branch, the second branch being stationary relative to the first branch, the second branch engageable with a first end portion of the elongated leg slot, the first branch engageable with a second end portion of the elongated leg slot after the second branch is engaged with the elongated leg slot and after the first branch is pivoted relative to the pivot channel, wherein the chassis system further defines a storage slot, wherein the leg is receivable within the storage slot to support the leg within the chassis system in a stored configuration in which the furniture system has a low profile, and wherein the storage slot includes a locking rib that is receivable between the first and second branches of the leg to secure the leg within the storage slot.

11. The furniture system of claim 10, wherein the first branch is coupled to the leg by a hinge.

12. The furniture system of claim 10, wherein the first branch includes a first tab on a first side thereof, and wherein the leg mount defines a first tab recess, the first tab recess is positioned to receive the first tab when the first branch pivots from a temporary position thereof to a permanent position thereof.

13. The furniture system of claim 10, wherein the leg includes flexible material.

14. The furniture system of claim 12, wherein the second branch includes a second tab on a first side thereof, and wherein the leg mount defines a second tab recess, the second tab recess configured to receive the second tab before the first tab.

15. The furniture system of claim 14, wherein the second tab acts a fulcrum about which the leg pivots.

16. The furniture system of claim 10, wherein the storage slot includes a protuberance that engages a bottom surface of the leg to facilitate securement of the leg within the storage slot.

17. The furniture system of claim 10, wherein the foot end portion of the leg is angled relative to the head end portion of the leg.

18. The furniture system of claim 10, further comprising a shelf assembly that is selectively attachable to the tabletop.

* * * * *